US011286127B2

(12) United States Patent
Yada

(10) Patent No.: US 11,286,127 B2
(45) Date of Patent: Mar. 29, 2022

(54) PRINTER

(71) Applicant: FUJITSU COMPONENT LIMITED, Tokyo (JP)

(72) Inventor: Yuji Yada, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/656,696

(22) Filed: Oct. 18, 2019

(65) Prior Publication Data

US 2020/0130970 A1 Apr. 30, 2020

(30) Foreign Application Priority Data

Oct. 26, 2018 (JP) ..... JP2018-201488

(51) Int. Cl.

| | |
|---|---|
| ***B65H 5/36*** | (2006.01) |
| ***B65H 7/10*** | (2006.01) |
| ***B65H 16/06*** | (2006.01) |
| ***B41J 15/04*** | (2006.01) |
| ***B41J 11/00*** | (2006.01) |

(52) U.S. Cl.

CPC ..... *B65H 5/36* (2013.01); *B41J 11/003* (2013.01); *B41J 15/042* (2013.01); *B65H 7/10* (2013.01); *B65H 16/06* (2013.01); *B65H 2301/3613* (2013.01); *B65H 2511/12* (2013.01); *B65H 2801/12* (2013.01)

(58) Field of Classification Search

CPC .. B65H 5/36; B65H 2301/3613; B65H 16/06; B65H 2511/12; B41J 15/042; B41J 11/003

See application file for complete search history.

(56) References Cited

U.S. PATENT DOCUMENTS

| | | | | |
|---|---|---|---|---|
| 5,110,106 | A * | 5/1992 | Matsumura | B65H 7/02 271/171 |
| 5,333,852 | A * | 8/1994 | Milillo | B65H 1/04 271/171 |
| 5,661,550 | A * | 8/1997 | Ko | B41J 11/003 399/45 |
| 6,609,844 | B1 * | 8/2003 | Petteruti | B41J 3/36 101/407.1 |
| 7,516,955 | B2 * | 4/2009 | Yamagishi | B65H 1/266 271/171 |
| 9,007,412 | B2 * | 4/2015 | Takahashi | B41J 29/13 347/222 |
| 2013/0183075 | A1 * | 7/2013 | Kim | B65H 16/028 400/619 |
| 2019/0118529 | A1 * | 4/2019 | Wong | B41F 33/16 |

FOREIGN PATENT DOCUMENTS

| | | |
|---|---|---|
| JP | 2000-302299 | 10/2000 |
| JP | 2017-013945 | 1/2017 |

* cited by examiner

*Primary Examiner* — Jeremy R Severson
(74) *Attorney, Agent, or Firm* — IPUSA, PLLC

(57) ABSTRACT

A printer includes a printer body including an installation area where a recording medium is installed, a print head that prints information on the recording medium, a controller, a movable guide that guides the side of the recording medium in the installation area, and a first switch that detects a position of the movable guide attached to the installation area. The controller performs a print control process corresponding to the width of the recording medium based on information obtained by the first switch.

2 Claims, 8 Drawing Sheets

PRINTER

CROSS-REFERENCE TO RELATED APPLICATION

The present application is based on and claims priority to Japanese Patent Application No. 2018-201488, filed on Oct. 26, 2018, the entire contents of which are incorporated herein by reference.

BACKGROUND OF THE INVENTION

1. Field of the Invention

An aspect of this disclosure relates to a printer.

2. Description of the Related Art

Printers are used, for example, for registers and mobile receipt issuing devices. In a printer using a rolled recording medium, the recording medium can be placed in a holder by opening a cover (See, for example, Japanese Laid-Open Patent Publication No. 2017-13945 and Japanese Laid-Open Patent Publication No. 2000-302299).

There are rolled recording media with various widths. If one printer can print information on recording media with various widths, the versatility of the printer is improved.

Accordingly, there is a demand for a printer that supports recording media with different widths.

SUMMARY OF THE INVENTION

According to an aspect of this disclosure, there is provided a printer that includes a printer body including an installation area where a recording medium is installed, a print head that prints information on the recording medium, a controller, a movable guide that guides the side of the recording medium in the installation area, and a first switch that detects a position of the movable guide attached to the installation area. The controller performs a print control process corresponding to the width of the recording medium based on information obtained by the first switch.

DESCRIPTION OF EMBODIMENTS

Embodiments of the present invention are described below. The same reference number is assigned to the same component, and repeated descriptions of the component are omitted.

Cases where paper rolls with different widths are used in a printer are described. A printer that can house a 4-inch-wide paper roll (4-inch paper) in a holder can also house, in the holder, a 3-inch-wide paper roll (3-inch paper) or 2-inch-wide paper roll (2-inch paper) whose width is narrower than 4 inches. Accordingly, it is possible to print information on 3-inch paper or 2-inch paper with a printer supporting 4-inch paper.

However, if a paper roll with a narrower width is placed in a holder supporting 4-inch paper, the paper roll moves in the holder. Therefore, a positioning part for positioning the paper roll with the narrower width is necessary.

Also, because a printer supporting 4-inch paper is designed to print information on the 4-inch paper, if information is printed on 3-inch paper or 2-inch paper without change, the printed information may overflow the 3-inch/2-inch paper. Thus, even if the paper roll is positioned by the positioning part, desired information may not be printed on the 3-inch/2-inch paper. Therefore, to print information on 2-inch paper, the printer needs to recognize that the paper roll set in the printer has a width of 2 inches.

If a printer can detect the width of 3-inch paper or 2-inch paper placed in a holder supporting 4-inch paper, the printer can perform a printing operation corresponding to the detected width, and the overflow of printed information can be prevented.

In view of the above considerations, a printer according to an embodiment of the present invention can detect the width of a recording medium placed in a holder and drive a print head according to the detected width. This enables the printer to print information on recording media with different widths.

Figure 1:
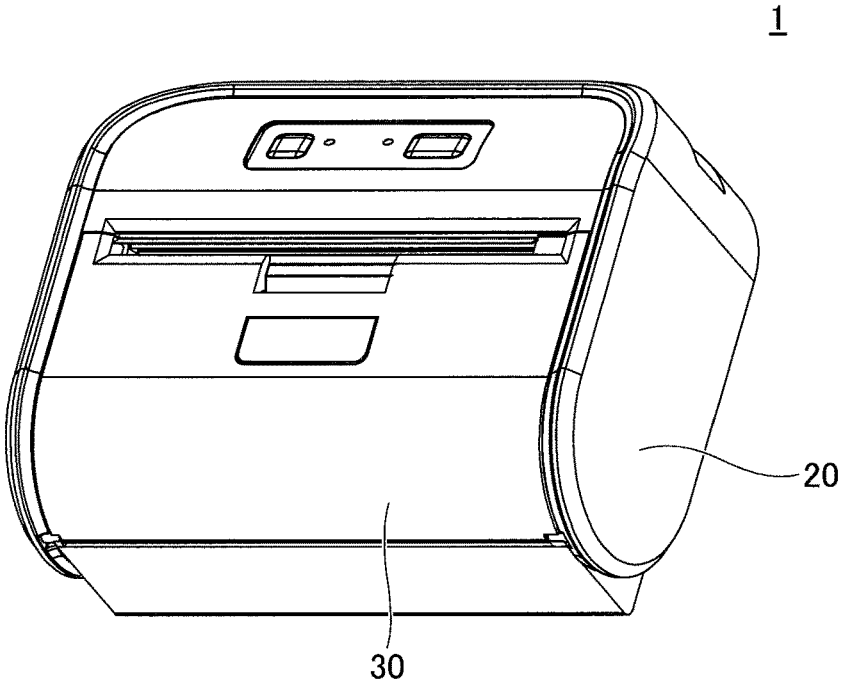
FIG. 1 is a perspective view of a printer according to an embodiment.
Figure 2:
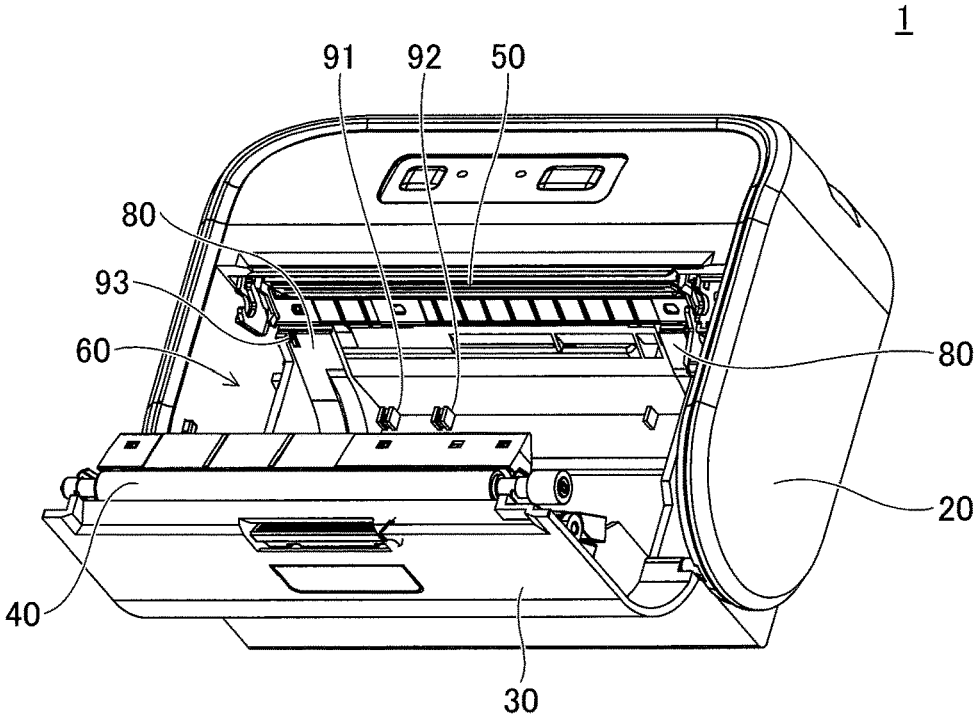
FIG. 2 is a perspective view of the printer.
Figure 3:
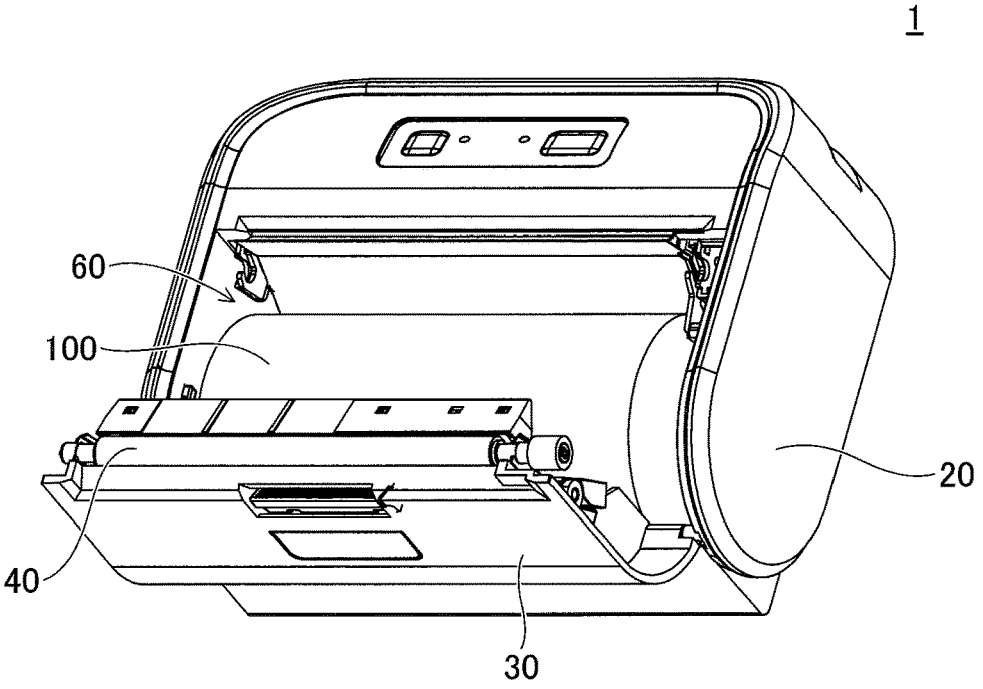
FIG. 3 is a perspective view of the printer.
Figure 4:
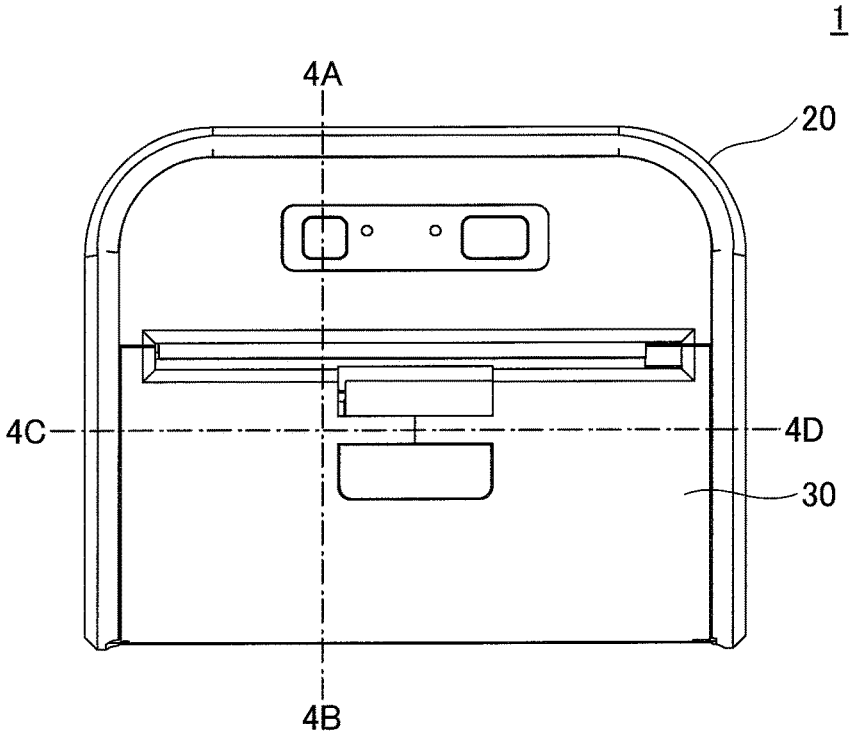
FIG. 4 is a top view of the printer.
Figure 5:
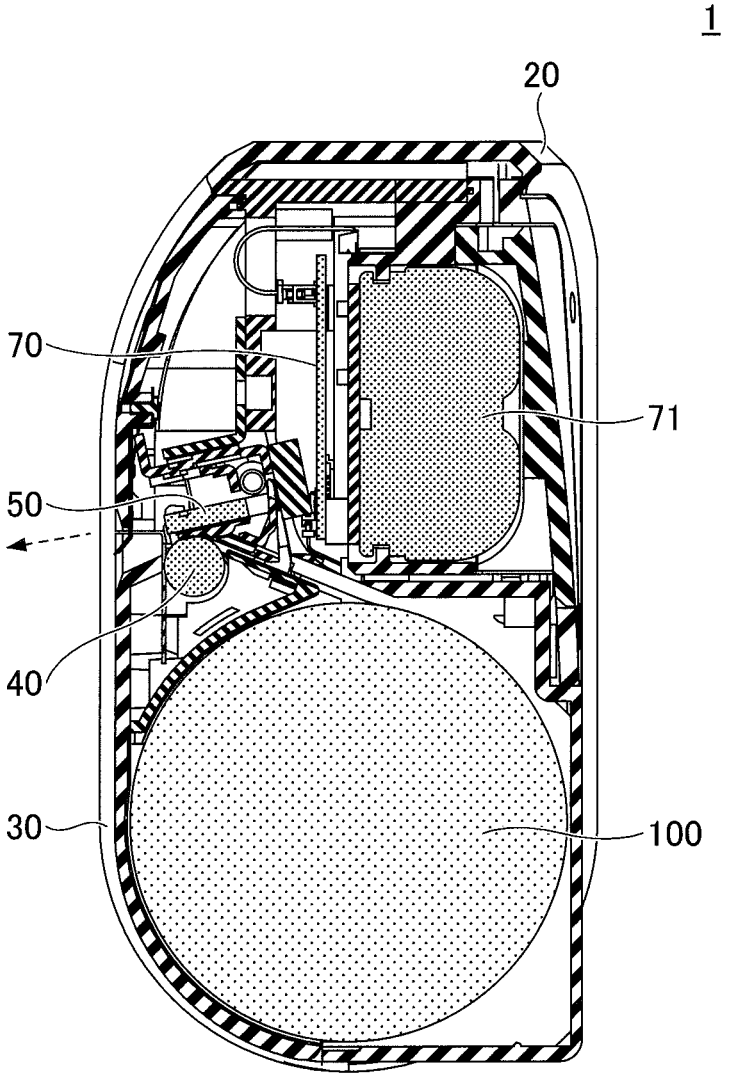
FIG. 5 is a cross-sectional view of the printer.
Figure 6:
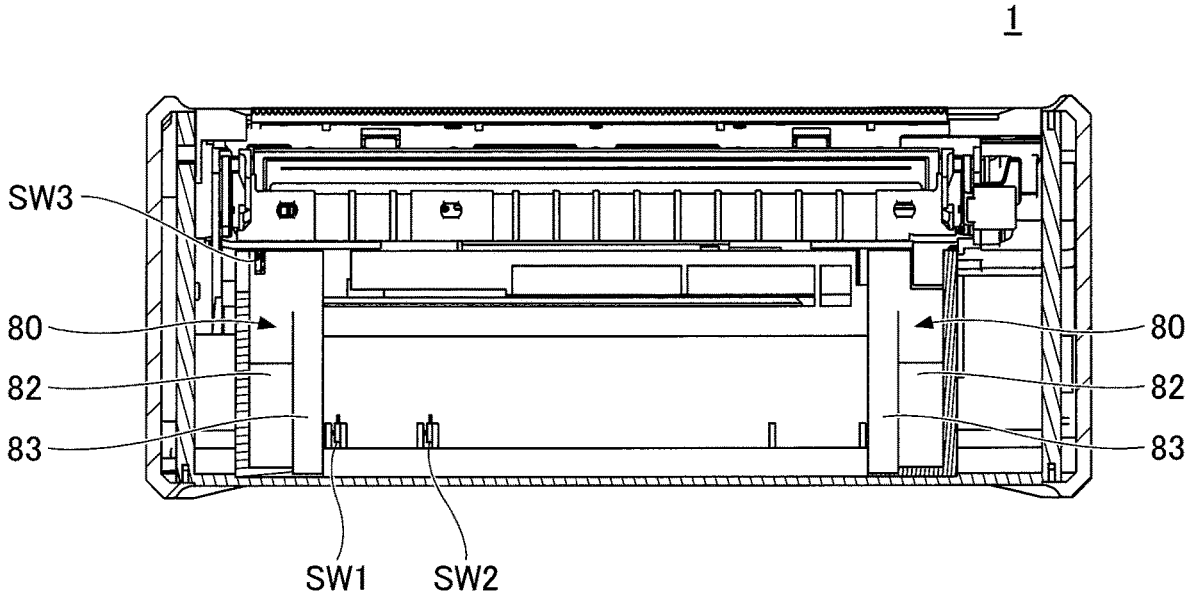
FIG. 6 is a cross-sectional view of the printer.
Figure 7:
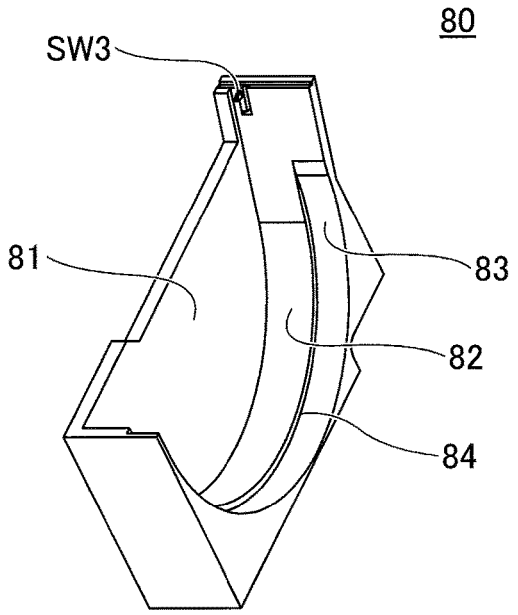
FIG. 7 is a perspective view of a guide.

FIG. 1 is a perspective view of a printer 1 according to an embodiment, FIG. 2 is a perspective view of the printer 1 with its cover opened, FIG. 3 is a perspective view of the printer 1 in which a recording medium is placed, FIG. 4 is a top view of the printer 1, FIG. 5 is a cross-sectional view taken along line 4A-4B of FIG. 4, and FIG. 6 is a cross-sectional view taken along line 4C-4D of FIG. 4.

The printer 1 includes a body 20 and a cover 30 that is rotatably connected to the body 20. A platen roller 40 is attached to the inside of the cover 30, and a print head 50 is attached to the inside of the body 20. A holder 60 in the body 20 is opened by opening the cover 30 so that a recording medium 100 can be placed in the holder 60. The recording medium 100 illustrated in FIG. 3 is, for example, 4-inch paper with a width of 114 mm.

The leading end of the recording medium 100 set in the printer 1 is sandwiched between the platen roller 40 and the print head 50, and the recording medium 100 is fed by the rotation of the platen roller 40 and ejected in the direction of an arrow in FIG. 5 after printing.

As illustrated in FIG. 5, the printer 1 includes a board 70 on which a circuit for controlling the printer 1 is formed. The printer 1 also includes a motor for rotating the platen roller 40 and a battery 71 for supplying power to drive the printer 1.

The printer 1 further includes movable guides 80 for guiding the sides of the recording medium 100 in the holder 60. Positions of the guides 80 in the holder 60 can be changed. Two guides 80 are provided to guide the corresponding sides of the recording medium 100, and are positioned symmetrically in the width direction of the recording medium 100 in the holder 60. Switches SW1 and SW2 for detecting the positions of the guides 80 are provided in the holder 60, and a switch SW3 for detecting the recording medium is provided on the guide 80. The switches SW1 and SW2 may be referred to as first switches, and the switch SW3 may be referred to as a second switch. In the present embodiment, the switches SW1, SW2, and SW3 are mechanical switches. However, the switches SW1, SW2, and SW3 may be implemented by optical switches.

A wall 81, which determines the position of the recording medium in the width direction, is provided on the outer side of each guide 80. A first holder 82 is formed on the inner side of the wall 81, and a second holder 83 is formed on the inner side of the first holder 82. A step 84 is formed between the first holder 82 and the second holder 83 such that the second holder 83 becomes deeper than the first holder 82. The guide 80 can be moved in the holder 60 in three steps in the width direction.

The first holder 82 and the second holder 83 have an arc shape corresponding to the paper roll. The switch SW3 is provided in a position corresponding to the first holder 82. The switch SW3 detects a recording medium in the first holder 82, but does not detect a recording medium in the second holder 83.

Figure 8:
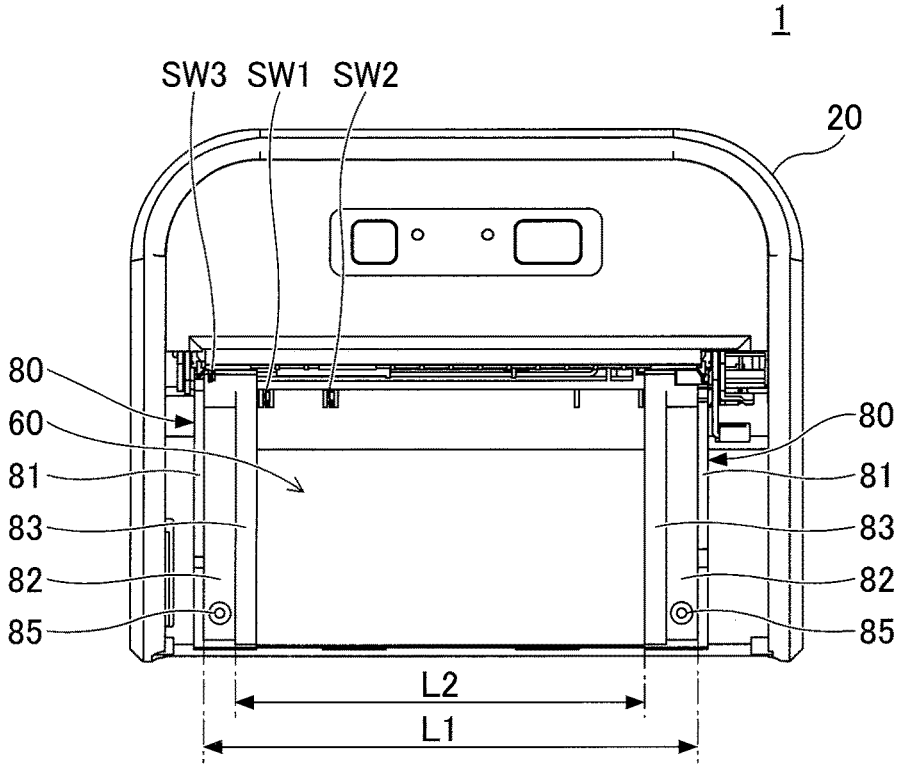
FIG. 8 is a drawing illustrating the printer.
Figure 9:
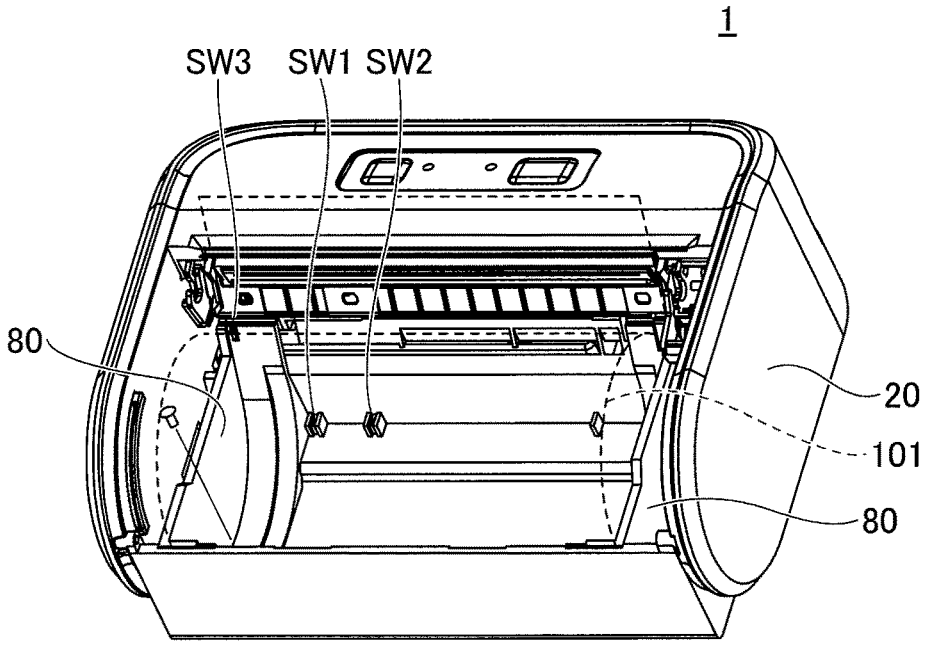
FIG. 9 is a drawing illustrating the printer.

FIGS. 8 and 9 illustrate a state of the printer 1 adapted for widest 4-inch paper 101. FIG. 8 is a top view and FIG. 9 is a perspective view of the body 20 where the recording medium 101 is indicated by a dotted line. The guide 80 includes a screw hole 85 for fixing the guide 80 with a screw. In the state of FIG. 8, the switch SW1 and the switch SW2 do not detect the guide 80. When a recording medium with a widest width L1 is placed in the printer 1, the recording medium enters the first holder 82 and is detected by the switch SW3. In the present embodiment, the width L1 corresponding to the width of the 4-inch paper is about 114 mm. A recording medium with a width L2, which is less than the width L1, enters the second holder 83 and is not detected by the switch SW3.

Figure 10:
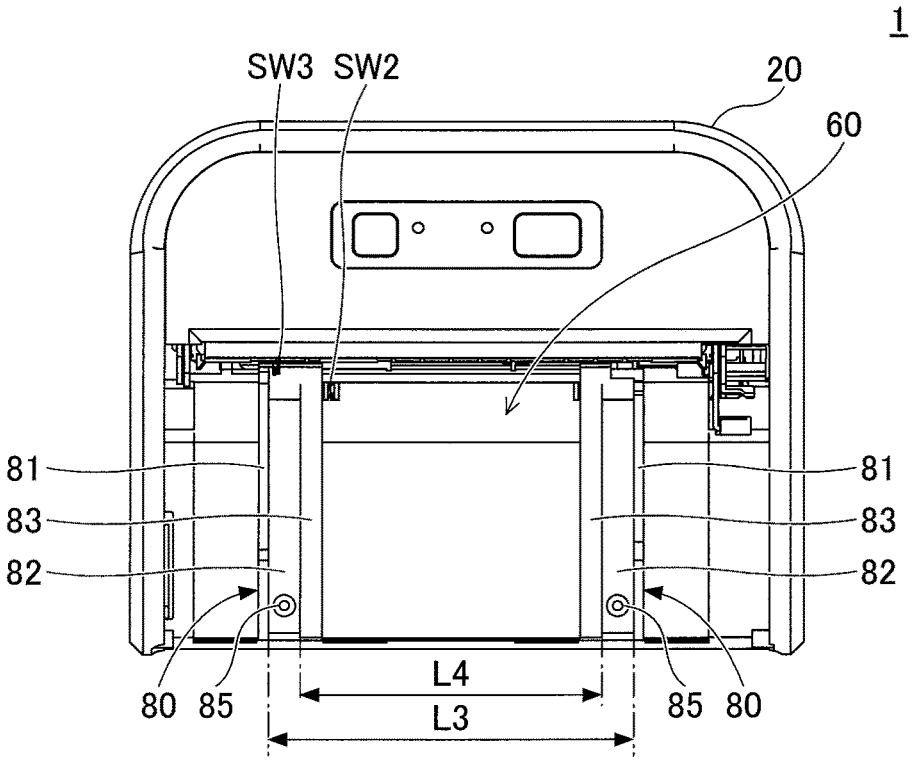
FIG. 10 is a drawing illustrating the printer.
Figure 11:
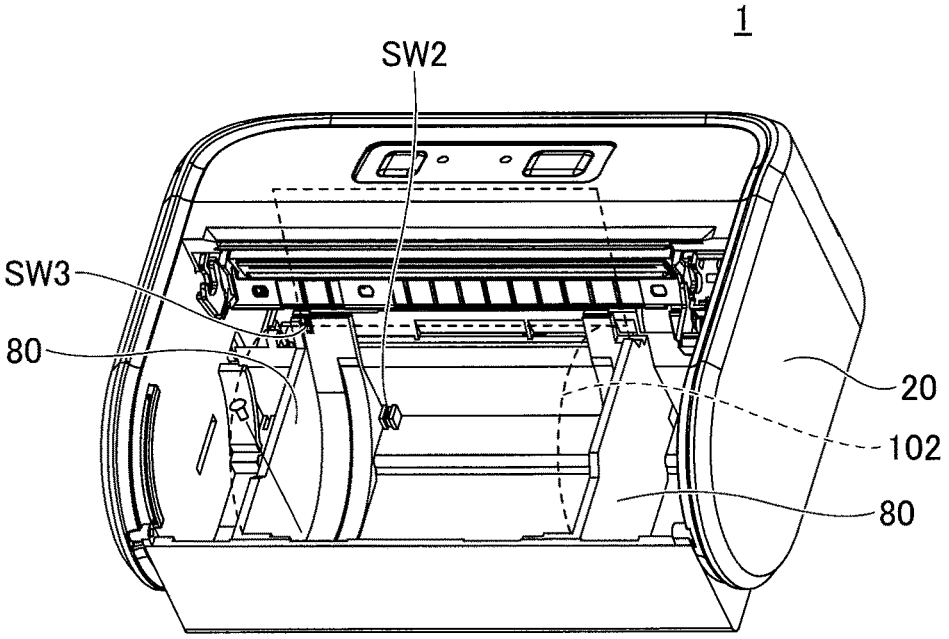
FIG. 11 is a drawing illustrating the printer.

FIGS. 10 and 11 illustrate a state of the printer 1 adapted for 3-inch paper 102 whose width is less than the width L2. FIG. 10 is a top view and FIG. 11 is a perspective view of the body 20 where the recording medium 102 is indicated by a dotted line. In FIG. 10, the switch SW1 detects the guide 80, but the switch SW2 does not detect the guide 80. When a recording medium with a width L3 is placed in the printer 1, the recording medium enters the first holder 82 and is detected by the switch SW3. The width L3 corresponding to the 3-inch paper is about 80 mm. A recording medium with a width L4, which is less than the width L3, enters the second holder 83 and is not detected by the switch SW3.

Figure 12:
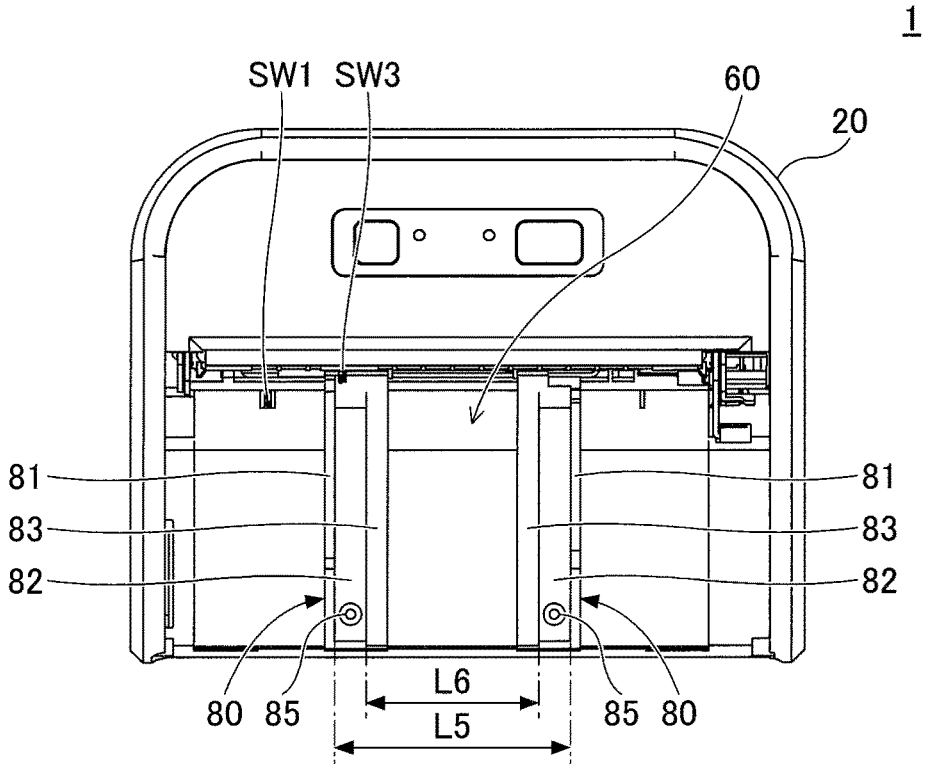
FIG. 12 is a drawing illustrating the printer.
Figure 13:
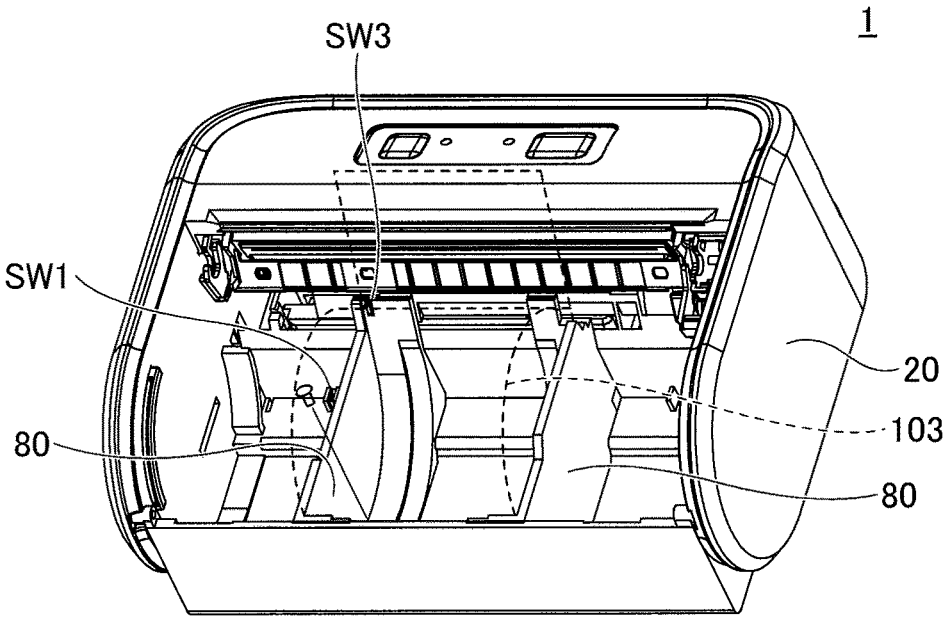
FIG. 13 is a drawing illustrating the printer.

FIGS. 12 and 13 illustrate a state of the printer 1 adapted for 2-inch paper 103 whose width is less than the width L4. FIG. 12 is a top view and FIG. 13 is a perspective view of the body 20, and the recording medium 103 is indicated by a dotted line. In FIG. 12, the switch SW1 does not detect the guide 80, but the switch SW2 detects the guide 80. When a recording medium with a width L5, which is less than the width L4, is placed in the printer 1, the recording medium enters the first holder 82 and is detected by the switch SW3. The width L5 corresponding to the 2-inch paper is about 58 mm. A recording medium with a width L6, which is less than the width L5, enters the second holder 83 and is not detected by the switch SW3.

Table 1 indicates the relationship between the widths of recording media and the ON and OFF of the switches SW1, SW2, and SW3. In Table 1, ON (1) indicates "detected" and OFF (0) indicates "not detected".

TABLE 1

| Width of recording medium | SW1 | SW2 | SW3 |
|---|---|---|---|
| L1 | 0 | 0 | 1 |
| L2 | 0 | 0 | 0 |
| L3 | 1 | 0 | 1 |
| L4 | 1 | 0 | 0 |
| L5 | 0 | 1 | 1 |
| L6 | 0 | 1 | 0 |

1: ON
0: OFF

Information obtained by the switches SW1, SW2, and SW3 is transmitted to the board 70, and the board 70 determines the width of the recording medium in the holder 60 and performs a control process corresponding to the determined width.

When determining that the recording medium has the width L1, the board 70 controls the print head 50 to suit 4-inch paper. When determining that the recording medium has the width L5, the board 70 controls the print head 50 to suit 2-inch paper. In this process, as necessary, a printing area to be printed by the print head 50 is limited by changing, for example, a print width. Also, three or more holders may be provided. In this case, the number of second switches may be determined by a formula "the number of holders−1".

A process performed by the printer 1 is described. The printer 1 determines the width of a recording medium in the holder 60 based on the ON and OFF of the switches SW1, SW2, and SW3, and performs a control process corresponding to the detected width of the recording medium.

Figure 14:
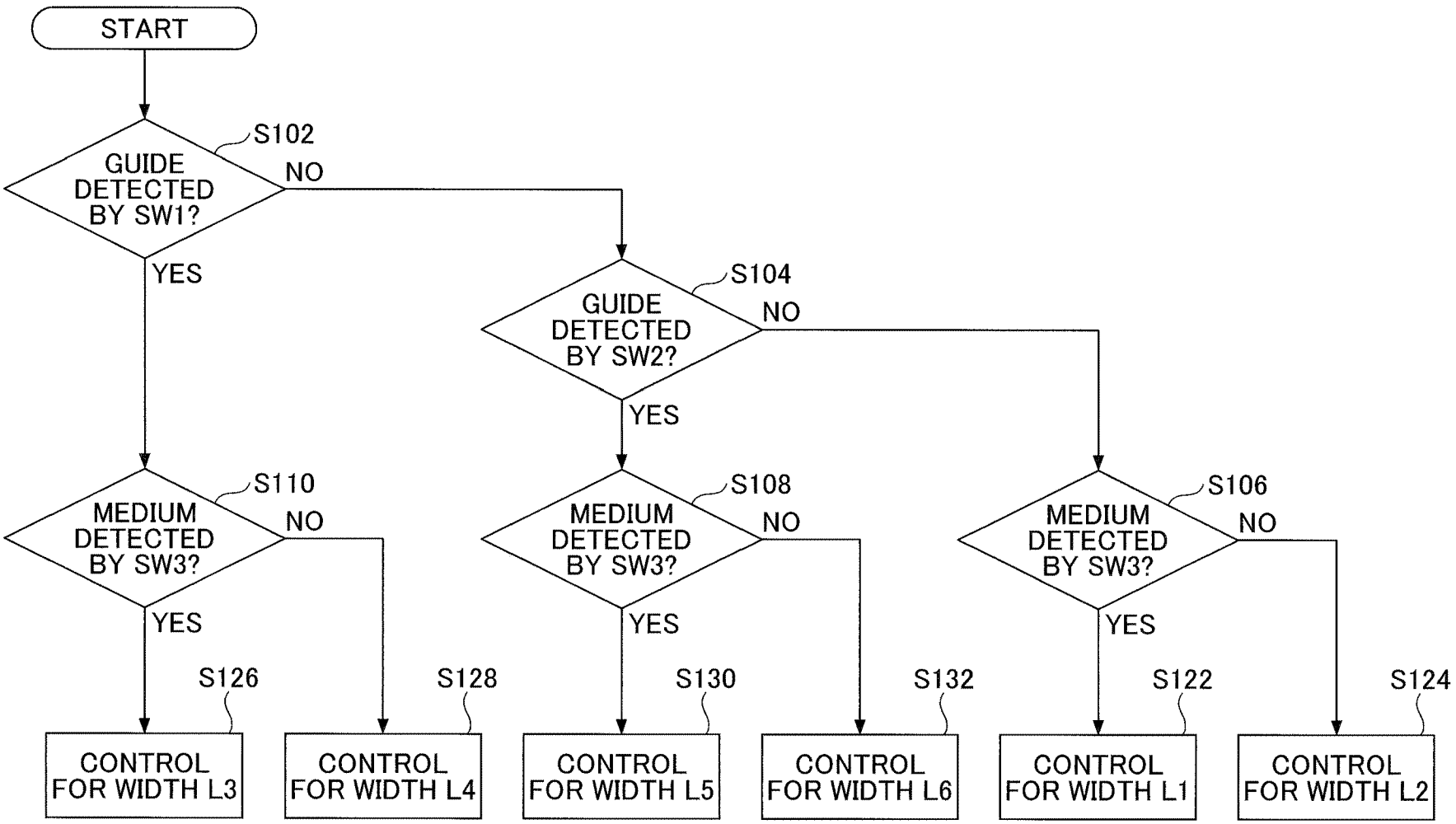
FIG. 14 is a flowchart illustrating a printer control process.

A process performed by the printer 1 is described with reference to FIG. 14.

At S102, the printer 1 determines whether the guide 80 is detected by the switch SW1. When the guide 80 is detected by the switch SW1 (YES at S102), the process proceeds to S110. When the guide 80 is not detected by the switch SW1 (NO at S102), the process proceeds to S104.

At S104, the printer 1 determines whether the guide 80 is detected by the switch SW2. When the guide 80 is detected by the switch SW2 (YES at S104), the process proceeds to S108. When the guide 80 is not detected by the switch SW2 (NO at S104), the process proceeds to S106.

At S106, the printer 1 determines whether the recording medium is detected by the switch SW3. When the recording medium is detected by the switch SW3 (YES at S106), the process proceeds to S122 where the printer 1 determines that the recording medium has the width L1 and performs a control process corresponding to the recording medium with the width L1. When the recording medium is not detected by the switch SW3 (NO at S106), the process proceeds to S124 where the printer 1 determines that the recording medium has the width L2 and performs a control process corresponding to the recording medium with the width L2.

At S108, the printer 1 determines whether the recording medium is detected by the switch SW3. When the recording medium is detected by the switch SW3 (YES at S108), the process proceeds to S130 where the printer 1 determines that the recording medium has the width L5 and performs a control process corresponding to the recording medium with the width L5. When the recording medium is not detected by the switch SW3 (NO at S108), the process proceeds to to S132 where the printer 1 determines that the recording medium has the width L6 and performs a control process corresponding to the recording medium with the width L6.

At S110, the printer 1 determines whether the recording medium is detected by the switch SW3. When the recording medium is detected by the switch SW3 (YES at S110), the process proceeds to S126 where the printer 1 determines that the recording medium has the width L3 and performs a control process corresponding to the recording medium with the width L3. When the recording medium is not detected by the switch SW3 (NO at S110), the process proceeds to S128 where the printer 1 determines that the recording medium has the width L4 and performs a control process corresponding to the recording medium with the width L4.

When a narrow recording medium is used and a platen roller and a head directly contact each other, the motor may become out of sync due to high friction between the platen roller and the head and insufficient torque of the motor and as a result, printing quality may be reduced. Detecting the width of a recording medium makes it possible to perform printing at a paper feed speed that is optimum for the width of the recording medium and thereby improve the printing quality. Also, with the configuration where a printer detects the width of a recording medium and controls printing, it is not necessary for a host to transmit blank data for an area where the recording medium is not present and to change the paper setting.

An embodiment of the present invention is described above. However, the present invention is not limited to the above-described embodiment.

What is claimed is:

1. A printer, comprising:

a printer body including an installation area where a recording medium is installed;

a print head that prints information on the recording medium;

a controller;

a movable guide that guides the side of the recording medium in the installation area; and a first switch that detects a position of the movable guide attached to the installation area, wherein the movable guide is provided on each side of the installation area and each includes a sidewall, a first holder disposed on an inner side of the sidewall, a second holder disposed on an inner side of the first holder, a step being formed between the first holder and the second holder, and a second switch that detects whether the recording medium is placed in the first holder or in the second holder; and the controller performs a print control process corresponding to the width of the recording medium based on information obtained by the first switch and information obtained by the second switch.

2. The printer as claimed in claim 1, wherein the first switch includes multiple first switches.

* * * * *